US011248623B2

(12) United States Patent
Haaf et al.

(10) Patent No.: US 11,248,623 B2
(45) Date of Patent: Feb. 15, 2022

(54) FAN WHEEL OF AN AXIAL VENTILATOR

(71) Applicant: ebm-papst Mulfingen GmbH & Co. KG, Mulfingen (DE)

(72) Inventors: Oliver Haaf, Kupferzell (DE); Thorsten Pissarczyk, Gemmingen (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 11 days.

(21) Appl. No.: 16/806,088

(22) Filed: Mar. 2, 2020

(65) Prior Publication Data

US 2020/0284268 A1 Sep. 10, 2020

(30) Foreign Application Priority Data

Mar. 4, 2019 (DE) ..... 102019105355.2

(51) Int. Cl.
*F04D 29/38* (2006.01)
*F04D 19/00* (2006.01)
*F04D 29/54* (2006.01)

(52) U.S. Cl.
CPC ..... *F04D 29/384* (2013.01); *F04D 19/002* (2013.01); *F04D 29/542* (2013.01); *F05B 2240/301* (2013.01)

(58) Field of Classification Search
None
See application file for complete search history.

(56) References Cited

U.S. PATENT DOCUMENTS 2,014,032 A * 9/1935 Sharpe ..... F04D 29/384 416/228
4,274,806 A * 6/1981 Gallardo, Jr. ..... F01D 5/20 415/173.4
4,662,823 A * 5/1987 Cooke ..... F04D 29/36 416/228
4,729,714 A * 3/1988 Wrobel ..... F04D 19/002 415/119
4,863,351 A * 9/1989 Fischer ..... B64C 11/00 416/203
5,297,931 A * 3/1994 Yapp ..... F04D 29/326 415/208.1
5,401,138 A * 3/1995 Mosiewicz ..... F03D 1/0675 416/226

(Continued)

FOREIGN PATENT DOCUMENTS

JP 11044432 A * 2/1999 ..... F04D 29/384

*Primary Examiner* — Michael Lebentritt
(74) *Attorney, Agent, or Firm* — Harness, Dickey & Pierce, P.L.C.

(57) ABSTRACT

An axial ventilator has multiple fan wheel blades (2) arranged around an axis of rotation (RA) in a blade ring. At least one of the fan wheel blades (2) has an inner section (3) located on the radial inside. A blade edge section (4) directly adjoins the inner section (3) and borders a blade edge (5). The at least one fan wheel blade (2) has a local projection (6) over a radial extension of the blade edge section (4). The local projection (6) is formed as an extension of the chord length of the fan wheel blade. The projection locally enlarges the fan wheel blade (2) in the blade edge section (4). An average angle of attack (α) of the fan wheel blade (2), in relation to a plane of rotation (RE), of the fan wheel (1), is larger than an average angle of attack (β) of the projection (6), in relation to the plane of rotation (RE).

16 Claims, 4 Drawing Sheets

(56) References Cited

U.S. PATENT DOCUMENTS

| | | | | |
|---|---|---|---|---|
| 5,681,145 | A * | 10/1997 | Neely | F04D 29/328 415/119 |
| 6,634,855 | B1 * | 10/2003 | Rollo | F04D 29/282 415/206 |
| 7,438,522 | B2 * | 10/2008 | Eimer | F04D 29/164 415/173.6 |
| 2006/0210397 | A1 * | 9/2006 | Eimer | F04D 29/164 415/220 |
| 2015/0184663 | A1 * | 7/2015 | Kwon | F25D 17/062 415/191 |
| 2017/0057621 | A1 * | 3/2017 | Evulet | B64C 15/00 |
| 2018/0051712 | A1 * | 2/2018 | Henner | F04D 29/386 |
| 2019/0078585 | A1 * | 3/2019 | Wei | F04D 29/384 |
| 2019/0120241 | A1 * | 4/2019 | Johnson | F04D 27/003 |
| 2020/0277962 | A1 * | 9/2020 | Keber | F04D 29/388 |

* cited by examiner

FAN WHEEL OF AN AXIAL VENTILATOR

CROSS-REFERENCE TO RELATED APPLICATION

This application claims priority to German Application No. 10 2019 105 355.2, filed Mar. 4, 2019. The disclosure of the above application is incorporated herein by reference.

FIELD

The disclosure relates to an axial ventilator fan wheel, with multiple fan wheel blades arranged around an axis of rotation in a blade ring.

BACKGROUND

Generic axial ventilators fan wheels that generate an axial airflow have been known for some time. Typically, they include a plurality of fan wheel blades. The blades, extending radially outward and originating from the hub, are arranged in a blade ring.

The noise generated due to turbulence is problematic. In particular, in installation conditions that are impaired with respect to the incoming flow and/or incident flow.

The disclosure is based on an object of providing a fan wheel that ensures a reduction of the noise level generated in operation, in particular, in such impaired installation conditions.

SUMMARY

This object is achieved by the feature combination according to an axial ventilator fan wheel with multiple fan wheel blades arranged around an axis of rotation (RA) in a blade ring. At least one of the fan wheel blades includes an inner section located on the radial inside and a blade edge section directly adjoining the inner section and bordering a blade edge. The at least one fan wheel blade comprises a local projection over a radial extension of the blade edge section. The projection is formed as an extension of a chord length of the fan wheel blade and locally enlarges the fan wheel blade in the blade edge section. An average angle of attack ($\alpha$) of the fan wheel blade, in relation to a plane of rotation of the fan wheel, is larger than an average angle of attack ($\beta$) of the projection, in relation to the plane of rotation (RE).

According to the disclosure, an axial ventilator fan wheel is proposed with multiple fan wheel blades arranged around an axis of rotation in a blade ring. At least one of the fan wheel blades comprises an inner section located on the radial inside and a blade edge section directly adjoining the inner section and bordering a blade edge. The at least one fan wheel blade comprises a local projection over a radial extension of the blade edge section. The projection is formed as an extension of the chord length of the fan wheel blade. This locally enlarges the fan wheel blade in the blade edge section. The blade edge section is thus delimited from the inner section and defined in that the projection is always provided. Furthermore, it is essential to the disclosure that an average angle of attack of the fan wheel blade, in particular in the blade edge section, in relation to a plane of rotation of the fan wheel is greater than an average angle of attack of the projection in relation to the plane of rotation.

The combination of the technical features, (1) the projection with an enlarged chord length in the blade edge section and (2) reducing the angle of attack of the projection in relation to the axis of rotation in relation to the remaining fan wheel blade at the same time, decreases the tendency of the flow to break away at the fan wheel and therefore decreases the blade passing noise, which is perceived to be particularly unpleasant.

In the fan wheel, one preferred embodiment has the average angle of attack of the projection, in relation to the plane of rotation of the fan wheel, at an angle between 1-15°, more preferably between 3-10°. The angle of attack of the projection is always less in this case than that of the fan wheel blade in the region outside the projection.

Many axial ventilator fan wheels use a ring clamped around the fan wheel blades on the radial exterior. This is frequently referred to as a slinging ring. One advantageous embodiment of the fan wheel of the present disclosure is especially directed to the fan wheel blades ending freely. The blades are free of connection at the respective radial blade edges. Thus, no ring or the like connects the fan wheel blades at the radial exterior. The radial outside blade edges of the fan wheel blades are fluidically uninfluenced by the free end. Thus, the effect of the projection is favorably applied.

Furthermore, preferably the fan wheel blade edge section of the at least one fan wheel blade adjoining the blade edge is defined in a radial outer region of the fan wheel blade. The size of this radial outer region and thus the radial extension of the projection is defined by the ratio of the radius LS of the fan wheel blade up to the blade edge section to the maximum radius of the fan wheel blade LD. Accordingly $0.7 \leq LS/LD \leq 1$, preferably $0.85 \leq LS/LD \leq 0.95$ applies.

With respect to the extension of the projection in the circumferential direction in the plane of rotation of the fan wheel, preferably the chord length of the fan wheel blade is locally enlarged by the extension in a direction perpendicular to the axis of rotation. This occurs in relation to the inner section such that $1.05 \leq L1/L2 \leq 1.4$, more preferably $1.1 \leq L1/L2 \leq 1.3$ applies. L1 is the maximum chord length of the blade edge section. L2 is the chord length of the fan wheel blade at the border between the intersection and the blade edge section. Each are measured at the blade edge located on the radial outside of the fan wheel blade.

The fan wheel blades each comprise a blade front edge and a blade rear edge. One particularly advantageous effect for noise reduction is achieved if the projection is formed on the blade front edge. The blade rear edge in turn has a complex curved, arc-shaped profile in one favorable embodiment. The blade front edge is preferably also a curved arc shape, but has a larger radius, in particular, multiple times larger than that of the blade rear edge.

Moreover, an embodiment variant of the fan wheel is advantageous where the projection is formed in one piece with the fan wheel blade. The fan wheel is preferably manufactured from plastic. Thus, all technical features influencing the flow are integrally formed in the fan wheel blades.

In one refinement of the fan wheel, the projection comprises a tip pointing in the circumferential direction. The tip is preferably spaced apart radially inward in relation to a maximum outer radius of the fan wheel blade. This means that the projection is indented radially inward. The tip preferably defines an imaginary circle in operation. The circle is spaced apart in relation to the outer radius of the fan wheel.

Furthermore, an embodiment variant of the fan wheel is advantageous where the tip of the projection is offset radially outward off-center in the blade edge section. In other words, the projection is formed in such a way that its tip pointing in the circumferential direction is located closer to the outer radius than to the inner section of the fan wheel blade.

Furthermore, a design of the fan wheel blades includes the tip of the projection rounded in each case. This has a fluidically advantageous and noise-reducing effect in the fan wheel.

In further advantageous embodiments of the fan wheel, the fan wheel blades each comprise a winglet at the radial outer blade edge. A winglet is defined as a formation on the fan wheel blade. It has a thickening or rounding from the lower side to the upper side at the radial end on the fan wheel blade. Moreover, brushes can optionally be provided in each case at the radial outer blade edge.

In a further embodiment, the fan wheel blades have a lesser average blade thickness at least along the projection than in the remaining region of the respective fan wheel blades.

The fan wheel blades each define a radial center region around the radial center. Here, the chord length of the fan wheel blade has a maximum. The center region preferably extends in this case up to 30% of the radial maximum extension of the fan wheel blades around the radial center.

Furthermore, in a preferred embodiment of the fan wheel, the fan wheel blades are formed identically.

The disclosure furthermore comprises an axial ventilator with the above-described fan wheel.

DRAWINGS

Other advantageous refinements of the disclosure are found in the dependent claims and/or are described in greater detail hereafter together with the description of the preferred embodiment of the disclosure on the basis of the figures. In the figures:

DETAILED DESCRIPTION

Figure 1:
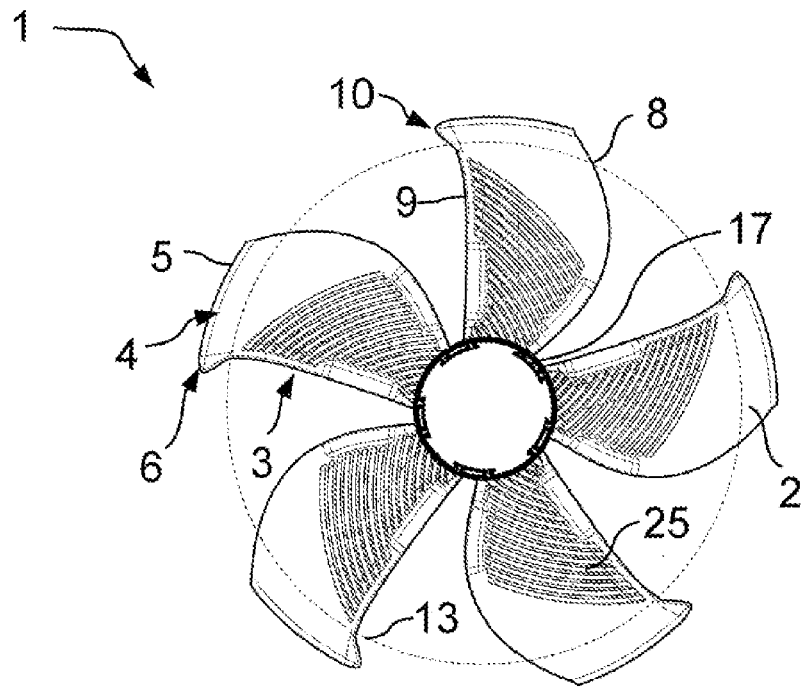
FIG. 1 is an axial top plan view of a fan wheel according to the disclosure.
Figure 2:
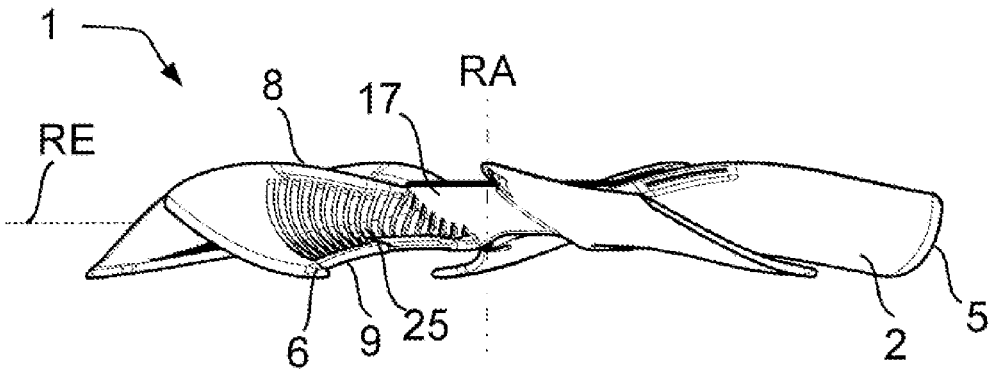
FIG. 2 is a side elevation view of the fan wheel according to FIG. 1.
Figure 3:
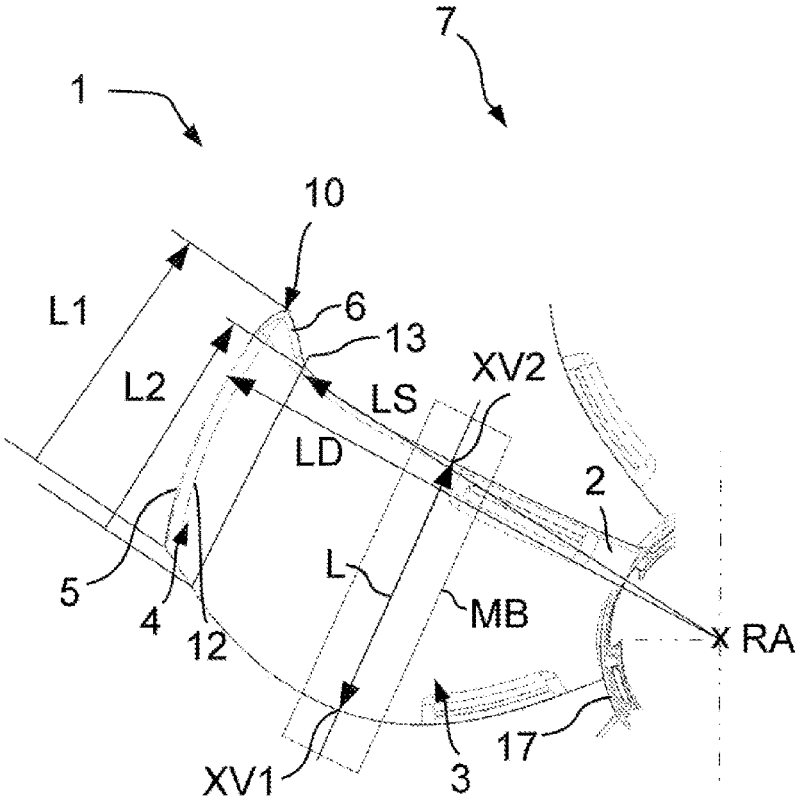
FIG. 3 is an enlarged perspective detail view of a fan wheel blade of the fan wheel according to FIG. 1 from the axially opposing side.

FIGS. 1-5 shows an exemplary embodiment of a fan wheel 1 of an axial ventilator. Five identical fan wheel blades 2 originating from the hub 17 extend radially outward from it. A blade ring is formed around the axis of rotation RA. The number of the fan wheel blades 2 is established as five solely by way of example. However, the number can also be higher or lower in alternative embodiments.

Each fan wheel blade 2 has a blade rear edge 8, a blade front edge 9, and a free ending radial blade edge 5. The individual fan wheel blade 2 are exclusively connected via the hub 17. The blade rear edges 8 are convexly rounded protruding in the circumferential direction and each defines an arc-shaped profile. The blade front edges 9 extend radially outward essentially linearly originating from the hub 17. As can be seen well in FIG. 2, the fan wheel blades 2 are formed bulging and inclined in relation to the plane of rotation RE. Reinforcing ribs 25, aligned in the circumferential direction, are formed on the respective axial lower side. The ribs extend partially up to the hub 17 and are connected over a predetermined axial extension.

The fan wheel blades 2 each comprise an inner section 3 located on the radial inside and a blade edge section 4. The blade edge section 4 is directly on the inner section 3 viewed in the radial direction and extends up to the respective blade edge 5. A dashed line is shown in FIG. 1 as the border 13 between the inner section 3 and the blade edge section 4. The blade edge section 4, located on the radial outside, is defined in each of the fan wheel blades 2. It includes the local projection 6 over its radial extension.

The projection 6 enlarges the chord length of the respective fan wheel blade 2 locally in the circumferential direction in the blade edge section 4. The border 13 is thus established at the point where the projection 6 begins. The projection 6 is formed in the embodiment shown at the respective blade front edge 9 in an essentially triangular basic shape. The projection 6 includes a rounded tip 10 pointing in the circumferential direction. A line is identified by the reference sign 12 in FIG. 3. The line indicates the position of the tip 10 in parallel to the blade edge 5. In this case, it is recognizable that the tip 10 of the projection 6 is spaced apart radially inward in relation to a maximum outer radius of the fan wheel blade 2. Thus, the tip 10 is offset radially outward off-center viewed in the radial direction in the blade edge section 4. This is achieved by different angle profiles of the outer edges of the projection 6, that are formed, on the one hand, by the blade front edge 9, on the other hand, by the blade edge 5.

Figure 4:
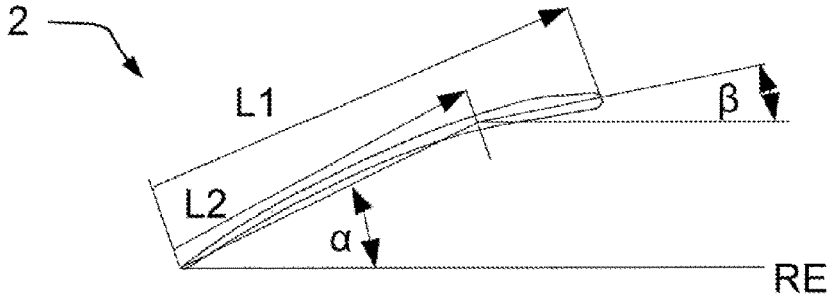
FIG. 4 is an enlarged elevation profile view of the radial blade edge of the fan wheel blade of the fan wheel from FIG. 1.
Figure 5:
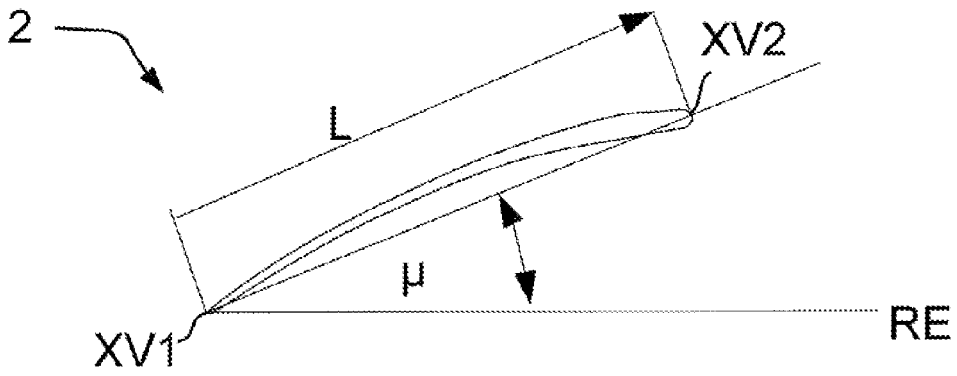
FIG. 5 is an enlarged elevation profile view on the radial blade edge of a fan wheel blade fan wheel from FIG. 1.

With reference to FIG. 4, the different average angles of attack $\alpha$, $\beta$ of the fan wheel blades 2 are shown in comparison to the projection 6. Each angle is in relation to the plane of rotation RE. The average angle of attack $\alpha$ of the fan wheel blades 2 in relation to the plane of rotation RE is 35°. The average angle of attack $\beta$ of the projection 6 in relation to the plane of rotation RE corresponds to 10°. Moreover, each angle of attack along the fan wheel blades 2, in relation to the plane of rotation RE, is always larger than each angle of attack along the projection 6, in relation to the plane of rotation RE. Furthermore, in FIG. 5, the total angle of attack $\mu$ of the fan wheel blades 2 along the chord length L is shown in the center region MB around the radial center. Chord length L connects the edge point XV1 at the blade rear edge 8 to the edge point XV2 at the blade front edge 9. In the center region MB, the chord length L has its maximum.

In the embodiment shown, the projection 6 is formed in one piece on the fan wheel blade 2, similarly its extension and the chord lengthening thus caused can be uniquely defined and delimited via the sudden profile change of the blade front edge 9. Alternative embodiments provide that the extension is fastened as an add-on part on the respective fan wheel blade.

The projection 6 in the blade edge section 4 occupies a radial extension that is defined via the ratio LS/LD, which is 0.88 in the case shown. LS is the radius of the fan wheel blade 2 up to blade edge section 4. LD is the maximum outer radius of the fan wheel blade 2. The radius LS/LD is to be between 0.7-1, in particular, between 0.85-0.98.

The size of the projection 6 in the circumferential direction is established via the different chord length. The chord length of the fan wheel blade 2 is enlarged by the projection 6 in the direction perpendicular to the axis of rotation RA in such a way that the ratio of the maximum chord length L1 of the fan wheel blade 2, including the projection 6, in relation to the chord length L2 of the fan wheel blade 2, without the projection 6, is 1.2. The ratio is to be defined as 1.05-1.3, in particular, between 1.1-1.2. Furthermore, the blade thickness of the projection 6 can optionally be greater than the blade thickness of the remaining fan wheel 2, as shown in FIG. 4.

Figure 6:
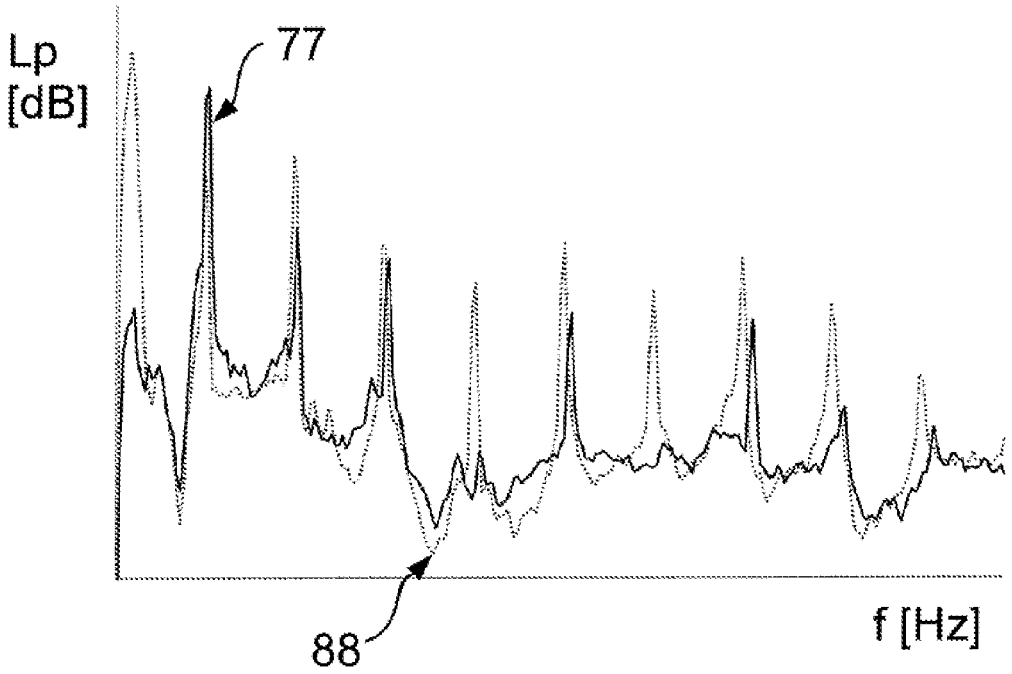
FIG. 6 is a diagram of the sound pressure level in relation to the frequency in the case of the fan wheel from FIG. 1 in relation to a fan wheel of the prior art.

FIG. 6 shows the advantages achieved by the design according to the disclosure of the fan wheel 2 for reducing the sound pressure level Lp at the different frequencies f. The solid line 77 represents the result of the fan wheel 2 according to FIG. 1. The dashed line 88 indicates an identical fan wheel without projection 6. The sound pressure level can be significantly reduced essentially over the entire frequency curve, but in particular at very low frequencies.

Figure 7:
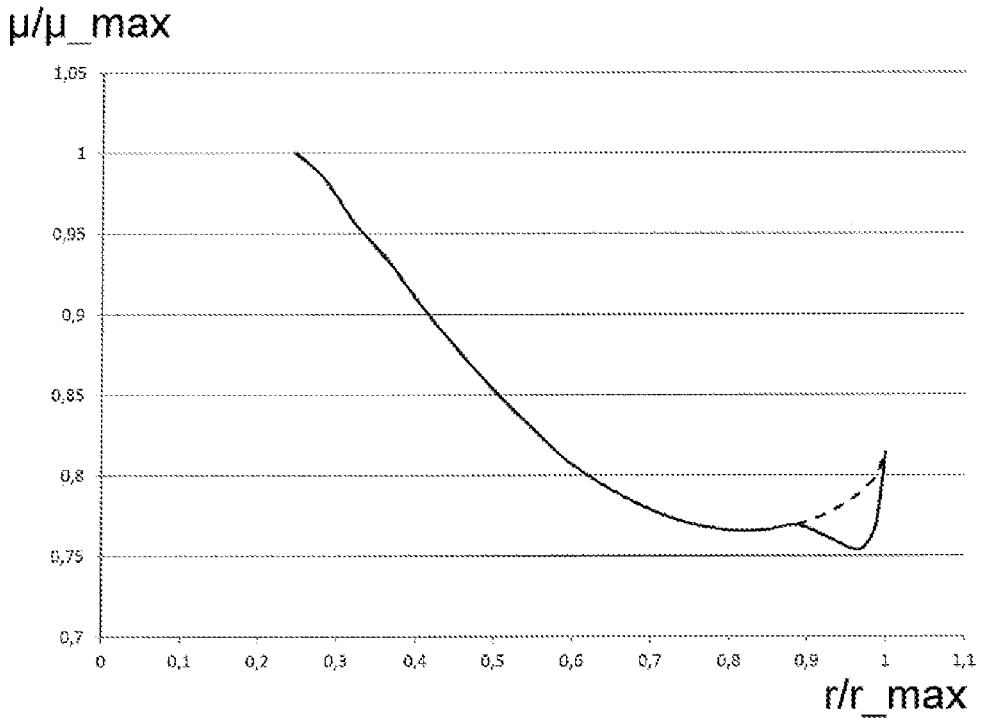
FIG. 7 is a diagram of the angle of attack of the fan wheel blades from FIG. 1 in relation to the prior art.

FIG. 7 shows a comparison of the ratio of the angle of attack μ to the maximum angle of attack μ_max of the fan wheel blade 2 having the projection 6 from FIG. 1 over the radial curve of the radius r to the maximum radius r_max in relation to the prior art (dashed line) without a projection. The falling angle of attack at the beginning of the blade edge section 4 can be seen well at a ratio r/r_max of 0.9.

Figure 8:
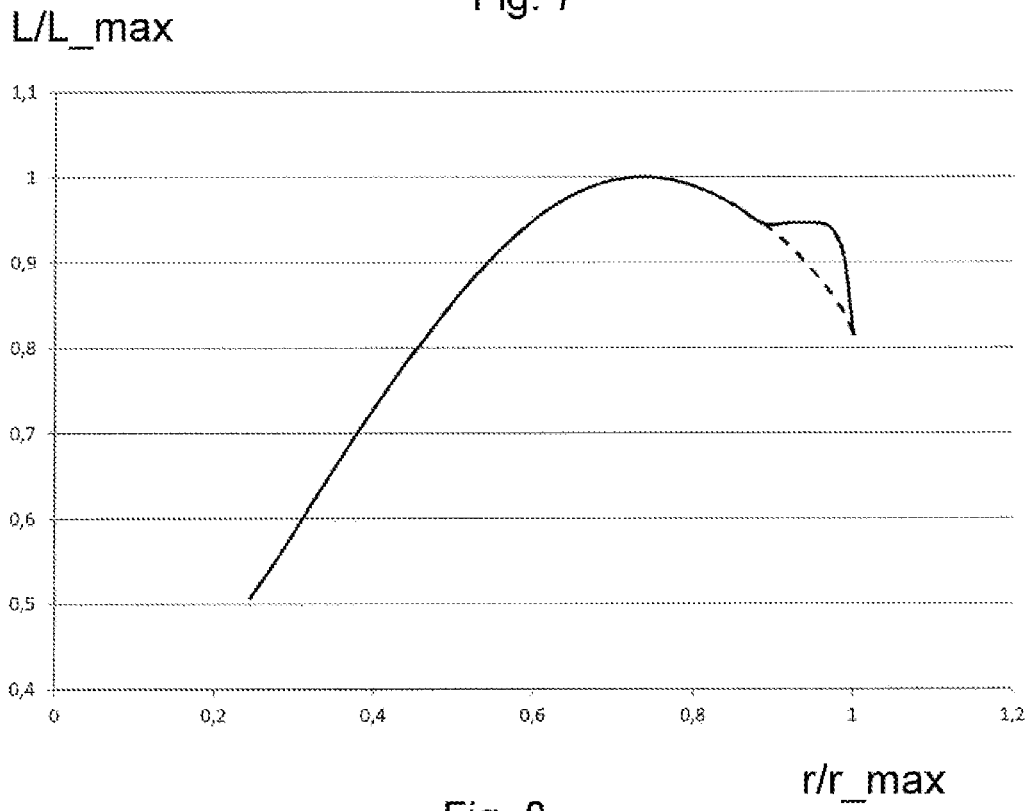
FIG. 8 is a diagram of the chord length of the fan wheel blade from FIG. 1 in relation to the prior art.

FIG. 8 shows a diagram of the chord length L in relation to the maximum chord length L_max of the fan wheel blade 2 having the projection 6 from FIG. 1 over the radial curve of the radius r in relation to the maximum radius r_max in relation to the prior art (dashed line) without a projection. The maximum of the chord length is 0.7 of the total radial extension of the fan wheel blade 2. The chord length is enlarged locally by the projection 6 in the blade edge section 4.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An axial ventilator fan wheel with multiple fan wheel blades arranged around an axis of rotation in a blade ring comprising a fan hub with at least one fan blade radiating from the hub, the at least one of the fan wheel blades comprises:

an inner section extending from the hub and located on the radial inside and a blade edge section directly adjoining the inner section and bordering a blade edge;

the at least one fan wheel blade comprises a local projection over a radial extension of the blade edge section, the projection is formed in extension of a chord length of the fan wheel blade and locally enlarges the fan wheel blade in the blade edge section; and an average angle of attack (α) of the fan wheel blade, in relation to a plane of rotation of the fan wheel, is larger than an average angle of attack (β) of the projection, in relation to the plane of rotation (RE).

2. The fan wheel according to claim 1, wherein the angle of attack (β) of the projection, in relation to the plane of rotation, has a value between 2-15°, in particular, between 4-10°.

3. The fan wheel according to claim 1, wherein the fan wheel blades end freely and are free of connections at the respective radial blade edges.

4. The fan wheel according to claim 1, wherein the blade edge section, adjoining the blade edge, of the at least one fan wheel blade is defined in an outer region of the fan wheel blade, such that $0.7 \leq LS/LD \leq 1$, in particular $0.85 \leq LS/LD \leq 0.95$ applies, and LD is a maximum radius of the fan wheel blade and LS is a radius of the fan wheel blade up to the blade edge section.

5. The fan wheel according to claim 1, wherein a chord length of the fan wheel blade is locally enlarged in relation to the inner section by the projection in a direction perpendicular to the axis of rotation, such that $1.05 \leq L1/L2 \leq 1.4$, in particular $1.1 \leq L1/L2 \leq 1.3$ applies, and L1 is a maximum chord length of the fan wheel blade in the blade edge section and L2 is a chord length of the fan wheel blade at the border between the inner section and the blade edge section.

6. The fan wheel according to claim 1, wherein the at least one fan wheel blade comprises a blade front edge and a blade rear edge, and the projection is formed on the blade front edge.

7. The fan wheel according to claim 6, wherein the blade rear edge has a convexly rounded, arc-shaped profile.

8. The fan wheel according to claim 1, wherein the projection is formed in one piece with the fan wheel blade.

9. The fan wheel according to claim 1, wherein the projection comprises a tip pointing in the circumferential direction, the tip is spaced apart radially inward in relation to a maximum outer radius of the fan wheel blade.

10. The fan wheel according to claim 9, wherein the tip is offset radially outward off-center in the blade edge section.

11. The fan wheel according to claim 9, wherein the tip is rounded.

12. The fan wheel according to claim 1, wherein the fan wheel blades each comprise a winglet on the radial outer blade edge.

13. The fan wheel according to claim 6, wherein the fan wheel blades have a greater average blade thickness in the region of the projection than in the remaining region of the fan wheel blade.

14. The fan wheel according to claim 1, wherein the fan wheel blade comprise a radial center section around a radial center of the respective fan wheel blade and the fan wheel blade has a maximum chord length in the center region.

15. The fan wheel according to claim 1, wherein all fan wheel blades of the fan wheel are formed identically.

16. An axial ventilator comprising a fan wheel according to claim 1.

* * * * *